US009463851B2

(12) United States Patent
Roodenburg et al.

(10) Patent No.: US 9,463,851 B2
(45) Date of Patent: Oct. 11, 2016

(54) DRILLING VESSEL AND A METHOD MAKING USE OF SAID DRILLING VESSEL

(71) Applicant: ITREC B.V., Schiedam (NL)

(72) Inventors: Joop Roodenburg, Delft (NL); Diederick Bernardus Wijning, Shiedam (NL)

(73) Assignee: ITREC B.V., Schiedam (NL)

( * ) Notice: Subject to any disclaimer, the term of this patent is extended or adjusted under 35 U.S.C. 154(b) by 0 days.

(21) Appl. No.: 14/395,362

(22) PCT Filed: Apr. 15, 2013

(86) PCT No.: PCT/NL2013/050270

§ 371 (c)(1),
(2) Date: Oct. 17, 2014

(87) PCT Pub. No.: WO2013/157936

PCT Pub. Date: Oct. 24, 2013

(65) Prior Publication Data

US 2015/0047547 A1 Feb. 19, 2015

Related U.S. Application Data

(60) Provisional application No. 61/636,013, filed on Apr. 20, 2012.

(51) Int. Cl.
*B63B 35/44* (2006.01)
*E21B 19/00* (2006.01)

(52) U.S. Cl.
CPC ..... *B63B 35/4413* (2013.01); *E21B 19/002* (2013.01)

(58) Field of Classification Search
CPC . B63B 35/4413; E21B 19/002; E21B 19/14; E21B 19/00; E21B 19/143; E21B 19/004
USPC ..... 114/264
See application file for complete search history.

(56) References Cited

U.S. PATENT DOCUMENTS

| | | | | |
|---|---|---|---|---|
| 2003/0159853 | A1 | 8/2003 | Archibald et al. | |
| 2008/0000685 | A1* | 1/2008 | Humphreys | E21B 15/02 175/5 |
| 2010/0071906 | A1* | 3/2010 | Rodrigues | B63B 35/4413 166/352 |

FOREIGN PATENT DOCUMENTS

| | | | |
|---|---|---|---|
| EP | 2 186 993 | A1 | 5/2010 |
| WO | WO 99/11901 | A1 | 3/1999 |
| WO | WO 2008/118914 | A1 | 10/2008 |
| WO | WO 2009/102196 | A2 | 8/2009 |
| WO | WO 2009/102197 | A2 | 8/2009 |

* cited by examiner

*Primary Examiner* — Anthony Wiest
(74) *Attorney, Agent, or Firm* — Birch, Stewart, Kolasch & Birch, LLP

(57) ABSTRACT

The invention relates to a drilling vessel for drilling in the earth's surface, comprising a dual firing line and a suspension carriage to move strings of drilling tubulars between the two firing lines, wherein the suspension carriage is provided with a stationary first suspension device and a moveable second suspension device, so that the second suspension device only requires a relatively small sideways motion in order to pass a string of drilling tubulars present in a firing line and to allow the first suspension device to approach and engage said string of drilling tubulars. The invention further relates to a method for replacing a string of drilling tubulars for another string of drilling tubulars in which use is made of a drilling vessel according to the invention.

20 Claims, 4 Drawing Sheets

DRILLING VESSEL AND A METHOD MAKING USE OF SAID DRILLING VESSEL

CROSS-REFERENCE TO THE RELATED APPLICATIONS

This application is the National Phase of PCT International Application No. PCT/NL2013/050270, filed on Apr. 15, 2013, which claims priority under 35 U.S.C. 119(e) to U.S. Provisional Application No. 61/636,013, filed on Apr. 20, 2012, all of which are hereby expressly incorporated by reference into the present application.

The invention relates to a drilling vessel for drilling in the earth's surface from said vessel, for example for oil or gas. Such a vessel is for example known from international patent publication WO 99/11901 in the name of the applicant.

In WO 99/11901 a drilling vessel is disclosed comprising a hull with a moonpool extending through the hull, a drilling tower or drilling mast, and an auxiliary tower or auxiliary mast provided next to the drilling tower or drilling mast. The drilling tower or drilling mast defines a drilling firing line vertically extending through the moonpool along which drilling can be carried out. The auxiliary tower or auxiliary mast defines a building firing line vertically extending through the moonpool along which a string of drilling tubulars, e.g. a drilling string or a casing string, can be build or dismantled.

The drilling vessel further comprises a suspension assembly with a carriage that is moveable between a first position near the drilling tower or drilling mast and a second position near the auxiliary tower or auxiliary mast. Provided on the carriage is a rotatable clamp block which supports a first and second clamp, said first and second clamp both being configured to hold a string of drilling tubulars suspended in the sea.

The first and second clamp allow to hold two strings of drilling tubulars at the same time and to quickly replace a string of drilling tubulars in the drilling firing line by another string of drilling tubulars by rotation of the clamp block relative to the carriage as depicted in FIGS. 2 and 3 of WO 99/11901. After rotating the clamp block the drill string previously located in the drilling firing line can be moved towards the building firing line to be dismantled.

An advantage of having a drilling firing line and a building firing line next to each other and being able to quickly exchange drill strings between said drilling firing line and said building firing line is that a considerable amount of time is saved with respect to the situation in which a single firing line for drilling and building is provided, and in which drilling, and building or dismantling can not be performed at the same time.

A disadvantage of the suspension assembly is that during a replacement operation as described in the prior art document WO99/11901, a lot of mass is moved around. Both the drill strings, the clamp block, and the two clamps are moved when replacing one drill string by the other drill string. This requires a lot of driving power not to mention the fact that moving the drill strings considerably at an upper end might cause undesired behavior of the drill strings at the lower end due to their length, e.g. an entangling or oscillating behavior.

It is therefor an object of the invention to reduce the amount of movement of the strings of drilling tubulars during replacement or exchanging of said strings of drilling tubulars by a suspension assembly.

This object is achieved by a drilling vessel according to claim 1. An advantage of the drilling vessel according to the invention is that besides a translational movement of the string of drilling tubulars between the first and second firing line, only a relatively small sideways movement of the second suspension device is required to let the second suspension device, possibly including a string of drilling tubulars, pass a string of drilling tubulars in the first or second firing line, thereby reducing the amount of power required to perform a replacement operation. No additional movement of the first suspension device is required during this operation. This is totally different from the known drilling vessel disclosed in WO99/11901 in which the first and second suspension devices are provided on opposite sides of the clamp block which is advantageous from rotation point of view, but which does not allow for retracting a suspension device so that the other suspension device can be reached without unduly moving the entire clamp block. In WO99/11901, the first and second clamp are always moved together.

The first and second suspension device are able to hold and support a string of tubulars and may be configured as clamps, but it is specifically mentioned here that configuring a suspension device as a clamp is not essential to the invention, but an option.

In some applications it may be the case that one suspension device is always holding a relatively light load compared to the other suspension device. It is then possible to configure the first suspension device to hold the relatively heavy loads and the second suspension device to hold the relatively light loads. As a result, the heavy load is kept stationary as much as possible, so that the moving mass, the required power and the complexity of the second suspension device can all be reduced when applying the invention.

The string of drilling tubulars may be any string formed by drilling string elements used in drilling operations and may thus for instance be a drill string having a bit mounted at one end. Another example of a string of drilling tubulars is a string of casing elements or a string of riser elements. The invention thus also applies to these applications and corresponding uses of drilling equipment.

In an embodiment, the vessel comprises a drilling system, e.g. including a tower or mast, drawworks, top drive, hoist blocks and/or heave compensation systems, adapted to carry out drilling along one of the first and second firing line. Preferably, the drilling system is adapted to carry out drilling along the second firing line.

In an embodiment, the drilling system is also configured to build or dismantle a string of drilling tubulars along the associated first or second firing line.

In an embodiment, the vessel comprises a building system, e.g. including a tower or mast, drawworks, hoist blocks, etc, adapted to build or dismantle a string of drilling tubulars along the other one of the first and second firing line. Preferably, the building system is adapted to build or dismantle the string of drilling tubulars along the first firing line.

In an embodiment, the building system is also configured to carry out drilling along the associated first or second firing line.

In an embodiment, the building system and drilling system make use of a common tower or mast, e.g. such that the first and second firing line respectively extend on opposite sides of the tower or mast. This is for instance shown in international patent publications WO2009/102196 and WO2009/102197, where a common mast is provided above a moonpool. By replacing the disclosed support carriage for transferring riser strings between the two firing lines by a suspension carriage according to the invention, strings of tubulars can easily be exchanged on these vessels while requiring minimal power.

In an embodiment, the moonpool may comprise two moonpool openings, so that the first firing line extends through one moonpool opening, and the second firing line extends through the other moonpool opening, wherein the two moonpool openings are connected to each other below the tower or mast to allow the suspension carriage to move from one moonpool opening to the other moonpool opening.

In an embodiment, the second suspension device is provided on an arm that is rotatably mounted to the suspension carriage about a vertically extending rotation axis, such that the second suspension device is moveable in a horizontal plane. Alternatively, the arm is rotatably mounted to the suspension carriage about a horizontally extending rotation axis, such that the second suspension device is moveable in a vertical plane having a nonzero angle to the carriage direction, preferably being perpendicular to the carriage direction. Preferably, the orientation of the second suspension device always remains such that a string of drilling tubulars when held by the second suspension device always has a vertical orientation.

In an embodiment, the suspension carriage comprises a U-shaped frame with two legs and a frame member connecting the two legs, wherein the first suspension device is provided on the frame member connecting the two legs of the U-shaped frame, and wherein the second suspension device is moveably mounted to one of the legs of the U-shaped frame. The U-shaped frame allows the first and second suspension device to approach a string of drilling tubulars from the same side, while being able to effectively support the suspension carriage from the vessel during holding of a string of drilling tubulars, because the legs of the U-shaped frame can be used to provide suitable support locations around the first and second suspension device, e.g. four support points distributed around the first and second suspension device, which provide a stable support without introducing large forces or torques in the frame and vessel when a string of drilling tubulars is held by the first and/or second suspension device.

In an embodiment, a free space in between the two legs of the U-shaped frame is large enough to allow the passage of a local bulge in the string of drilling tubulars, for instance caused by a blow-out preventer (BOP). In some embodiments, in which the second suspension device is moveable in said space to positions where the second suspension device blocks the passage of the local bulge, the second suspension device is preferably moveable to a third position relative to the suspension carriage to allow the passage of said local bulge in the string of drilling tubulars, wherein preferably the second suspension device is positioned in, above or below the suspension carriage in the third position to make full use of the free space.

In an embodiment, the suspension carriage is a skid cart and the vessel comprises skid beams along which the suspension carriage is able to move in the carriage direction.

The suspension carriage preferably includes a drive system to move the suspension carriage in the carriage direction. In case of the suspension carriage being a skid cart to be moved along skid beams on the vessel, the drive system may include hydraulic actuators and clamp feet, wherein the clamp feet are able to grip the skid beams and the hydraulic actuators are able to move the suspension carriage relative to the clamp feet.

The use of two firing lines makes it possible to prepare a second string of drilling tubulars in one firing line while a first string of drilling tubulars is being used for drilling in the other firing line. There is no need to wait with the construction of the second string of drilling tubulars until the moment when the first string of drilling tubulars has been raised in its entirety to the drilling vessel.

With the suspension carriage according to the invention, it is possible, when the bottom side (e.g. the bit) of the first string of drilling tubulars has been raised from the drill hole, to hold both strings of drilling tubulars at the same time and to replace the first string of drilling tubulars with the second string of drilling tubulars in an efficient manner. The replacing may be performed by a method according to the invention which will be described below.

The drilling vessel according to the invention may alternatively be described as a drilling vessel for drilling in the earth's surface from said vessel, for example for oil or gas, comprising:

- a hull with a moonpool extending through the hull,
- a first firing line extending substantially vertically through the moonpool;
- a second firing line extending substantially vertically through the moonpool remote from the first firing line;
- a suspension carriage, wherein the suspension carriage is moveable in a substantially horizontal carriage direction;
- a first suspension device provided on the suspension carriage to hold a string of drilling tubulars suspended in the sea;
- a second suspension device provided on the suspension carriage to hold a string of drilling tubulars suspended in the sea;

wherein the first suspension device is fixed to the suspension carriage to provide a stationary suspension position relative to the suspension carriage, such that the first suspension device is moveable along a path by movement of the suspension carriage in the carriage direction, said path intersecting at least the first and second firing line to allow the first and second suspension device to hold a string of drilling tubulars at either one of the first and second firing line and move said string of drilling tubulars to the other one of the first and second firing line, wherein the second suspension device is moveable relative to the suspension carriage in at least a horizontal direction perpendicular to the carriage direction to provide a moveable suspension position relative to the suspension carriage, wherein the second suspension device is moveable between a first position relative to the suspension carriage, in which the second suspension device is positioned on the path at a portion of the path bounded by the first suspension device and a corresponding path end, and a second position relative to the suspension carriage, in which the second suspension device is positioned remote from said portion of the path, and wherein the suspension carriage and the second suspension device are configured, such that when the second suspension device is positioned in the second position said portion of the path is free seen in plan view to allow the first suspension device to approach and engage a string of drilling tubulars along said portion of the path.

The drilling vessel according to the invention may alternatively be described as a drilling vessel for drilling in the earth's surface from said vessel, for example for oil or gas, comprising:

- a hull with a moonpool extending through the hull,
- a first firing line extending substantially vertically through the moonpool;
- a second firing line extending substantially vertically through the moonpool remote from the first firing line;

a suspension carriage, wherein the suspension carriage is moveable in a substantially horizontal carriage direction;

a first suspension device provided on the suspension carriage to hold a string of drilling tubulars suspended in the sea;

a second suspension device provided on the suspension carriage to hold a string of drilling tubulars suspended in the sea;

wherein the suspension carriage and each of the first suspension device and the second suspension device are configured to move a string of drilling tubulars between the first firing line and the second firing line while suspending said string of drilling tubulars, wherein the second suspension device is moveable relative to the suspension carriage in a direction with a horizontal component perpendicular to the carriage direction of the suspension carriage, such that the second suspension device is moveable between a first position relative to the suspension carriage in which the second suspension device is able to reach the first and second firing line by movement of the suspension carriage in the carriage direction, and a second position relative to the suspension carriage in which the second suspension device, possibly supporting a string of drilling tubulars, is able to pass the first and second firing line without interfering with a string of drilling tubulars that may be present in said first and second firing line, wherein the first suspension device is fixed to the suspension carriage to provide a stationary suspension position relative to the suspension carriage.

The invention also relates to a method in which use is made of a drilling vessel according to the invention, said method comprising the following steps starting from the suspension carriage being positioned in the retracted position:

a) providing a first string of drilling tubulars in the first firing line;

b) providing a second string of drilling tubulars in the second firing line;

c) moving the suspension carriage from the retracted position to the first firing line;

d) holding the first string of drilling tubulars with one of the first and second suspension device;

e) moving the suspension carriage from the first firing line towards the second firing line;

f) providing the second suspension device in the second position;

g) passing the second firing line with the second suspension device being in the second position;

h) holding the second string of drilling tubulars with the other one of the first and second suspension device;

i) positioning the first string of drilling tubulars in the second firing line and releasing the first string of drilling tubulars;

j) providing the second suspension device in the first position;

k) moving the suspension carriage from the second firing line to the first firing line;

l) positioning the second string of drilling tubulars in the first firing line and releasing the first string of drilling tubulars;

m) moving the suspension carriage to the retracted position.

In an embodiment, the steps are performed in the following order: a)-b)-f)-c)-d)-e)-j)-h)-i)-f)-g)-k)-j)-l)-m), wherein the first string of drilling tubulars is held by the first suspension device, and wherein the second string of drilling tubulars is held by the second suspension device, and wherein the subsequent steps e) and j) and the subsequent steps k) and j) may also be performed in the reverse order.

In an embodiment, the steps are performed in the following order: a)-b)-j)-c)-d)-e)-f)-g)-h)-j)-i)-k)-f)-l)-m), wherein the first string of drilling tubulars is held by the second suspension device, and wherein the first string of drilling tubulars is held by the first suspension device, and wherein the subsequent steps e) and f) and/or the subsequent steps k) and f) and/or the subsequent steps f) and l) may be performed in the reverse order.

In an embodiment, the first string of drilling tubulars is a drill string, e.g. a drill string with a drill bit at one end.

In an embodiment, the second string of drilling tubulars is a drill string, e.g. a drill string with a drill bit at one end.

In an embodiment, the second string of drilling tubulars is a casing string.

The invention also relates to a method in which use is made of a drilling vessel according to an embodiment of the invention, said method comprising the following steps starting from the suspension carriage being positioned in the retracted position:

a) providing a first string of drilling tubulars in the first firing line;

b) providing a second string of drilling in the second firing line;

c) providing the second suspension device in the second position;

d) moving the suspension carriage from the retracted position to the first firing line;

e) holding the first string of drilling tubulars with the first suspension device;

f) providing the second suspension device in the first position;

g) moving the suspension carriage from the first firing line to the second firing line;

h) holding the second string of drilling tubulars with the second suspension device;

i) positioning the first string of drilling tubulars in the second firing line and releasing the first string of drilling tubulars by the first suspension device;

j) providing the second suspension device in the second position;

k) passing the first string of drilling tubulars in the second firing line with the suspension carriage while the second suspension device is in the second position;

l) moving the suspension carriage to the first firing line;

m) providing the second suspension device in the first position;

n) positioning the second string of drilling tubulars in the first firing line and releasing the second string of drilling tubulars by the second suspension device.

In an embodiment, the method comprises the step of returning to the retracted position of the suspension carriage.

The invention also relates to a method in which use is made of a drilling vessel according to an embodiment of the invention, said method comprising the following steps starting from the suspension carriage being positioned in the retracted position:

a) providing a first string of drilling tubulars in the first firing line;

b) providing a second string of drilling in the second firing line;

c) providing the second suspension device in the first position;

d) moving the suspension carriage from the retracted position to the first firing line;

e) holding the first string of drilling tubulars with the second suspension device;

f) providing the second suspension device in the second position;

g) moving the suspension carriage from the first firing line to the second firing line;

h) passing the second string of drilling tubulars in the second firing line with the suspension carriage while the second suspension device is in the second position;

i) holding the second string of drilling tubulars with the first suspension device;

j) providing the second suspension device in the first position;

k) positioning the first string of drilling tubulars in the second firing line and releasing the first string of drilling tubulars by the second suspension device;

l) moving the suspension carriage to the first firing line;

m) positioning the second string of drilling tubulars in the first firing line and releasing the second string of drilling tubulars by the first suspension device.

In an embodiment, the method comprises the steps of providing the second suspension device in the second position, passing the second string of drilling tubulars in the first firing line with the suspension carriage while the second suspension device is in the second position, and returning to the retracted position of the suspension carriage.

The invention also relates to a suspension assembly for use in a drilling vessel according to the invention and/or a method according to the invention, comprising:

a suspension carriage with a recess having a U-shaped contour and an opening through which strings of drilling tubulars can be received in said recess, said recess being formed by two legs and a frame member bridging said two legs;

a first suspension device provided at or near the frame member; and a second suspension device provided at or near the opening of the recess, wherein the suspension carriage is configured to be moveable in a carriage direction, wherein the first suspension device is fixed to the suspension carriage to provide a stationary suspension position relative to the suspension carriage, and wherein the second suspension device is moveable relative to the suspension carriage in a direction perpendicular to the carriage direction between a first position relative to the suspension carriage and a second position relative to the suspension carriage, said first position being a position in which the second suspension device is able to approach and engage with a string of drilling tubulars entering the recess via said opening, and said second position being a position in which the first suspension device is able to approach and engage with a string of drilling tubulars entering the recess via said opening.

The invention also relates to a drilling vessel for drilling in the earth's surface from said vessel, for example for oil or gas, comprising:

a hull with a moonpool extending through the hull;

a first firing line extending substantially vertically through the moonpool;

a second firing line extending substantially vertically through the moonpool remote from the first firing line;

a suspension carriage, wherein the suspension carriage is moveable in a substantially horizontal carriage direction between the first and second firing line;

a first suspension device provided on the suspension carriage to hold a string of drilling tubulars suspended in the sea; and a second suspension device provided on the suspension carriage to hold a string of drilling tubulars suspended in the sea, wherein each of the first and second suspension devices is moveable relative to the suspension carriage in at least a direction perpendicular to the horizontal traveling direction of the suspension carriage between a first position, in which the first and second suspension devices are able to approach and engage with a string of drilling tubulars in the first or second firing line, and a second position, in which the first and second suspension devices are not able to approach and engage with a string of drilling tubulars in the first or second firing line, and wherein each of the first and second suspension devices has an associated driving device, so that the first and second suspension device can be moved between the first and second position by the respective driving device independent of each other.

The invention also relates to a suspension assembly for use in the abovementioned drilling vessel according to the invention, comprising:

a suspension carriage, wherein the suspension carriage is moveable in a substantially horizontal carriage direction;

a first suspension device provided on the suspension carriage to hold a string of drilling tubulars suspended in the sea; and a second suspension device provided on the suspension carriage to hold a string of drilling tubulars suspended in the sea, wherein each of the first and second suspension devices is moveable relative to the suspension carriage in at least a direction perpendicular to the horizontal traveling direction of the suspension carriage between a first position and a second position, and wherein each of the first and second suspension devices has an associated driving device, so that the first and second suspension device can be moved between the first and second position by the respective driving device independent of each other.

An advantage of this drilling vessel and suspension assembly is that first and second suspension devices can be operated independent from each other, so that the total moving mass can be reduced compared to WO 99/11901 where the first and second suspension devices are always moved together. A further advantage may be that the suspension carriage and first and second suspension devices can be configured such that the first and second firing line can be approached from both sides to engage with a string of drilling tubulars. This can for instance be embodied by providing a carriage with the first and second suspension devices positioned at one side of the carriage, which side is extending parallel to the carriage direction and is moveable next to the first and second firing line, so that the suspension carriage alone does not comprise parts that may interfere with the first and second firing line while passing the first and second firing line.

In an embodiment, the first and second suspension devices are only translatable in a direction perpendicular to the carriage direction. In an alternative embodiment, the first and second suspension devices are rotatable about a vertically extending rotation axis in order to be moved between the respective first and second positions.

Features described earlier in relation to other embodiments of the invention may also be applied to the above-mentioned embodiments of the drilling vessel and suspension assembly where applicable and are not repeated here.

The invention will now be described in a non-limiting way with reference to the accompanying drawings, in which like reference numerals indicate like parts, and in which.

Figure 1:
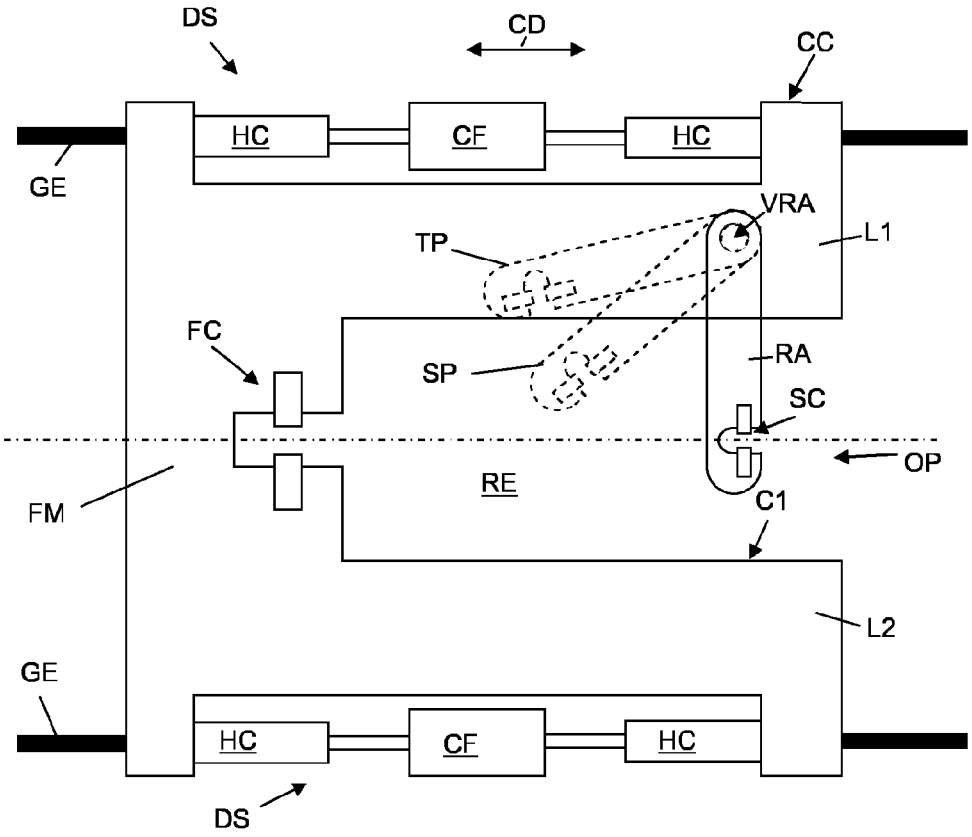
FIG. 1 depicts a suspension assembly according to an embodiment of the invention, which can be used in a drilling vessel according to an embodiment of the invention.

FIG. 1 depicts a suspension assembly according to an embodiment of the invention. The suspension assembly comprises a suspension carriage CC, a first suspension device FC provided on the suspension carriage CC and a second suspension device SC provided on the suspension carriage CC. Each of the first and second suspension device FC, SC is configured to hold a string of drilling tubulars, thereby suspending the string of drilling tubulars from a drilling vessel into the sea.

The suspension carriage CC comprises two legs L1, L2 and a frame member FM bridging the two legs L1, L2, thereby forming a recess RE with a U-shaped contour C1, which recess RE is bounded by the frame member FM on one end and by an opening OP on the other end.

The first suspension device FC is provided at a recess side of the frame member FM. The second suspension device SC is provided on a rotatable arm RA, which is rotatably mounted to leg L1 to be rotatable about a substantially vertical rotation axis VRA. The rotatable arm RA and the second suspension device SC are shown in three positions. The position drawn in solid lines is referred to as the first position of the second suspension device relative to the suspension carriage. The position drawn in dashed lines in which the second suspension device is still located in the recess RE will be referred to as the second position SP. The position drawn in dashed line in which the second suspension device has moved entirely into leg L1 will be referred to as the third position TP.

The two legs L1, L2 allow to sufficiently support the suspension carriage CC on two longitudinal guiding elements GE, e.g. skid beams, extending beneath the suspension carriage, thereby allowing to carry the suspension carriage including a string of drilling tubulars. The suspension carriage is configured to be moveable relative to the guiding elements in a carriage direction CD parallel to the guiding elements. The suspension carriage therefore comprises a driving system DS on each leg L1, L2.

Each driving system comprises a clamp feet CF configured to engage and disengage with one of the respective guiding elements GE. The clamp feet CF can be moved relative to the respective leg L1, L2 in the carriage direction by two hydraulic cylinders HC provided between the clamp feet CF and the respective leg L1, L2. When the clamp feet engages with the guiding elements, driving the hydraulic cylinders will move the suspension carriage in the carriage direction relative to the guiding elements. When the clamp feet is disengaged from the guiding elements, driving the hydraulic cylinders moves the clamp feet relative to the suspension carriage which is stationary relative to the guiding elements.

Figure 2:
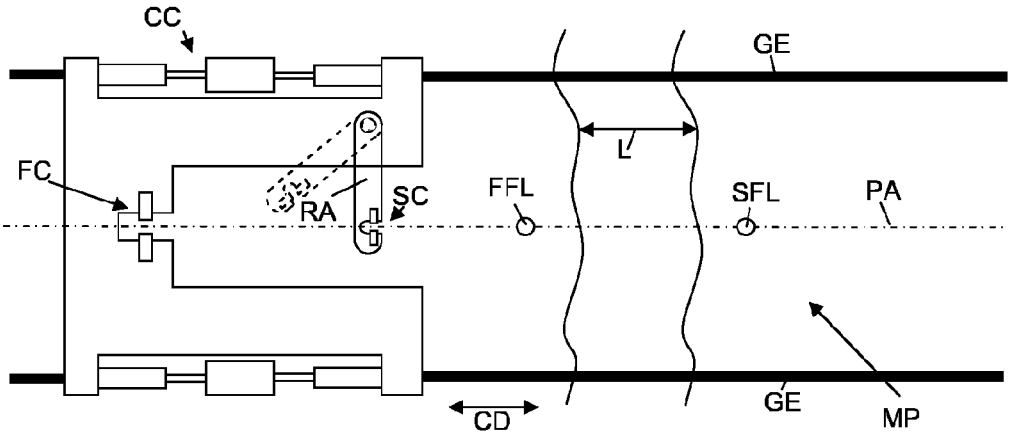
FIG. 2 depicts the suspension assembly of FIG. 1 in a partially shown drilling vessel according to an embodiment of the invention.

The suspension assembly of FIG. 1 is also shown in FIG. 2 in a partially shown drilling vessel according to an embodiment of the invention. The vessel comprises a hull and extending through the hull a moonpool MP. In this example, the moonpool has an elongated rectangular shape bounded by guiding elements GE at each side.

Extending through the moonpool is a first firing line FFL. The first firing line in this example is defined by a drilling system including a drilling tower or mast, which drilling system is adapted to carry out drilling along the first firing line.

Remote from the first firing line FFL, a second firing line SFL is extending through the moonpool. The second firing line in this example is defined by a building system including a tower or mast, which building system is adapted to build or dismantle a string of drilling tubulars in the second firing line.

In FIG. 2, the distance between the first and second firing line is relatively small, but in practice the distance L will be larger. For simplicity reasons, the distance L is depicted smaller in FIG. 2. At the location of distance L, a mast or tower may be provided as is the case for the vessels disclosed in WO2009/102196 and WO2009/102197, which vessels are suitable to apply the invention to.

The suspension assembly of FIG. 1 is shown in FIG. 2 and depicts the suspension carriage CC, wherein the suspension carriage is moveable in a substantially horizontal carriage direction CD. Further shown are the first suspension device FC and the second suspension device SC each provided on the suspension carriage to hold a string of drilling tubulars suspended in the sea.

The first suspension device FC is fixed to the suspension carriage CC to provide a stationary suspension position relative to the suspension carriage. The second suspension device SC is moveable relative to the suspension carriage, in this example by being arranged on the rotatable arm RA, in at least a horizontal direction perpendicular to the carriage direction CD between a first position (shown in solid lines) relative to the suspension carriage and a second position (shown in dashed lines) relative to the suspension carriage.

Both the first suspension device and the second suspension device, when in the first position, are moveable along a path PA by movement of the suspension carriage in the carriage direction CD. The path starts at a retracted position (shown in FIG. 2) of the suspension carriage CC, in which the suspension carriage CC, first suspension device FC and second suspension device SC do not interfere with normal drilling and building operations in the first and second firing line, and subsequently intersects the first and second firing line respectively.

When the second suspension device SC is in the first position relative to the suspension carriage, the second suspension device is able to approach and engage with a string of drilling tubulars in the first or second firing line starting from the retracted position, because the second suspension device is located at the path PA through the first and second firing line.

When the second suspension device is in the second position relative to the suspension carriage, the second suspension device is retracted from the path PA, thereby leaving a path portion extending from the first suspension device towards the first and second firing line free, so that the first suspension device is able to approach and engage with a string of drilling tubulars in the first or second firing line starting from the retracted position.

Figure 3:
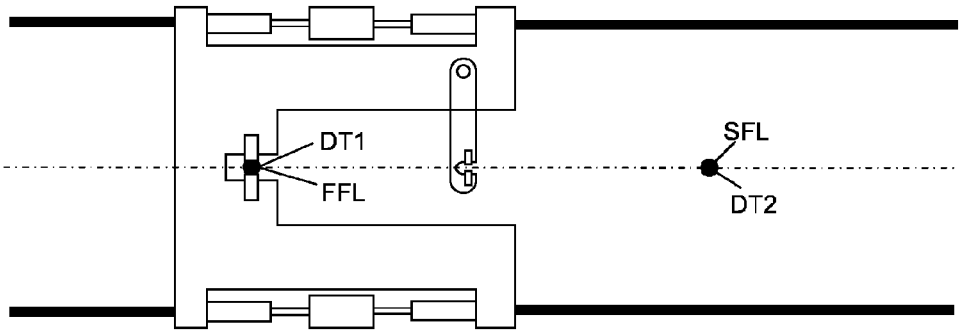
FIGS. 3-8 depict different moments in a method according to an embodiment of the invention, wherein use is made of a drilling vessel and suspension assembly as shown in FIGS. 1 and 2.
Figure 4:
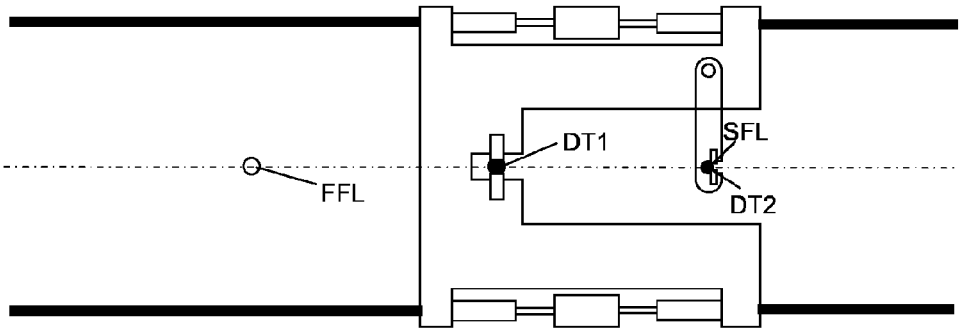
Figure 5:
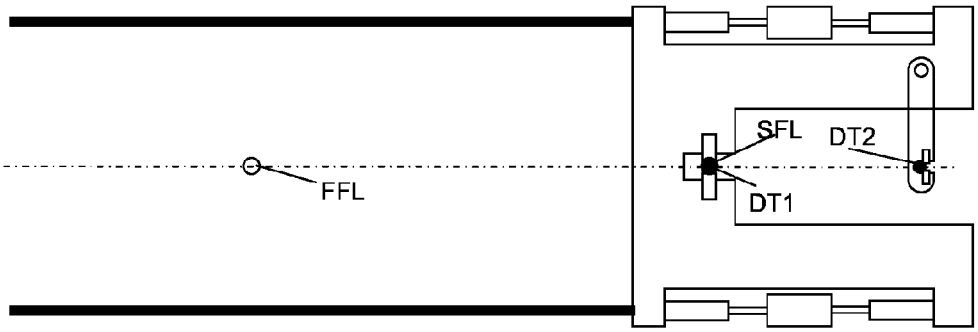
Figure 6:
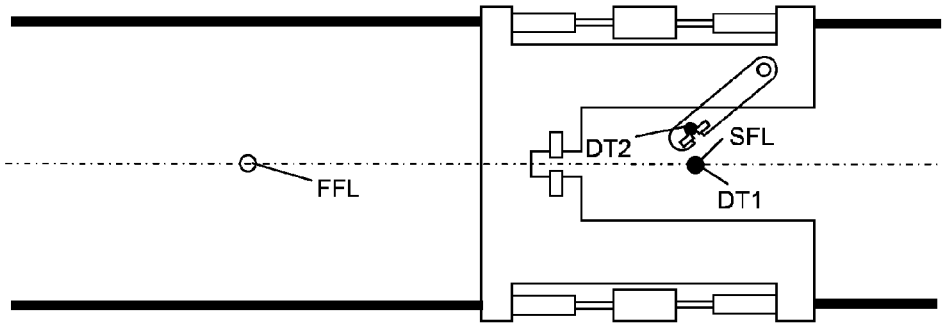
Figure 7:
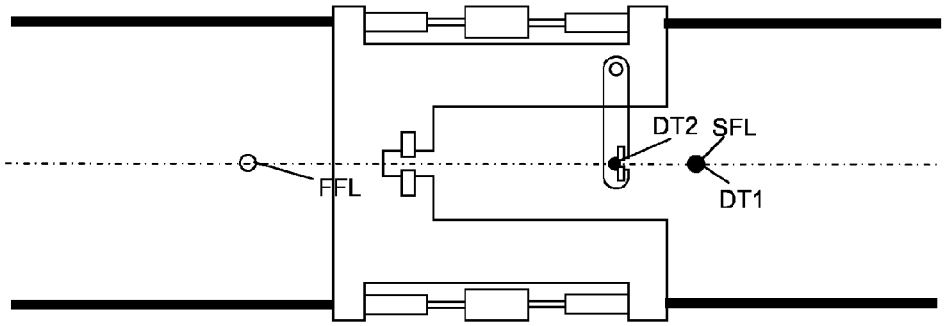
Figure 8:
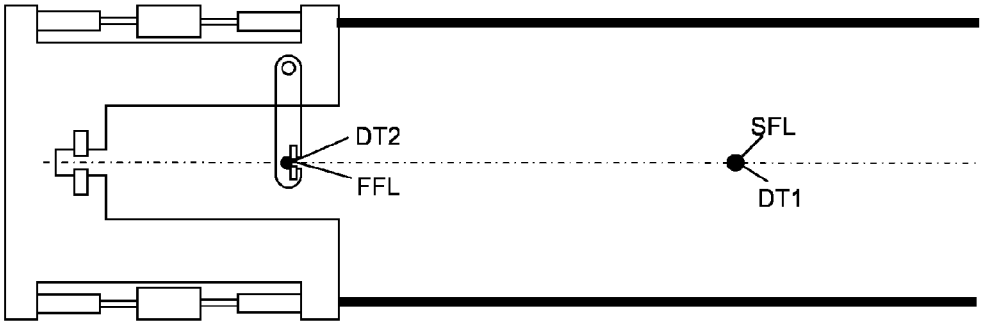

The drilling vessel can be used to carry out the following method as shown with reference to the FIGS. 3-8 and starting from the suspension carriage being positioned in the retracted position as shown in FIG. 2:

a) providing a first string of drilling tubulars DT1 in the first firing line FFL. The first string of drilling tubulars may be a drill string used to drill a hole in the earth's surface;

b) providing a second string of drilling tubulars DT2 in the second firing line SFL. The second string of drilling tubulars may be a drill string to replace the drill string in the first firing line, e.g. due to wear of the drill bit. The second string of drilling tubulars may have been built while the first string of drilling tubulars is used in the first firing line;

c) providing the second suspension device in the second position (see the dashed line rotation arm in FIG. 2) in order to be able to pass the first string of drilling tubulars;

d) moving the suspension carriage along the guiding elements from the retracted position towards the first firing line until the first suspension device is able to engage with the first string of drilling tubulars;

e) holding the first string of drilling tubulars using the first suspension device and moving the second suspension device towards the first position. This situation is shown in FIG. 3.

f) moving the suspension carriage towards the second firing line until the second suspension device is able to engage with the second string of drilling tubulars;

g) holding the second string of drilling tubulars using the second suspension device. This situation is shown in FIG. 4.

h) moving the suspension carriage, thereby positioning the first string of drilling tubulars in the second firing line. This situation is shown in FIG. 5.

i) releasing the first string of drilling tubulars in the second firing line by the first suspension device;

j) moving the second suspension device to the second position in order to pass the first string of drilling tubulars in the second firing line when the suspension carriage is moving towards the retracted position, i.e. in the direction of the first firing line;

k) moving the suspension carriage towards the first firing line until the second suspension device, which holds the second string of drilling tubulars, has passed the second firing line in which the first string of drilling tubulars is located without interfering with the first string of drilling tubulars. FIG. 6 depicts the situation in which the second suspension device just passes the second firing line.

l) moving the second suspension device to the first position as shown in FIG. 7 after having passed the second firing line.

m) moving the suspension carriage towards the first firing line until the second string of drilling tubulars held by the second suspension device is positioned in the first firing line as depicted in FIG. 8.

n) releasing the second string of drilling tubulars and moving the suspension carriage towards the retracted position brings us back to the starting point of this method.

It will be appreciated by the person skilled in the art that the above described vessel and method are only exemplary, and that other methods and vessels may also fall within the scope of the invention. For example, the movement of the second suspension device from the second position to the first position as shown with reference to FIGS. 6 and 7, may also be performed at a later moment in time then depicted in FIG. 7.

Figure 9:
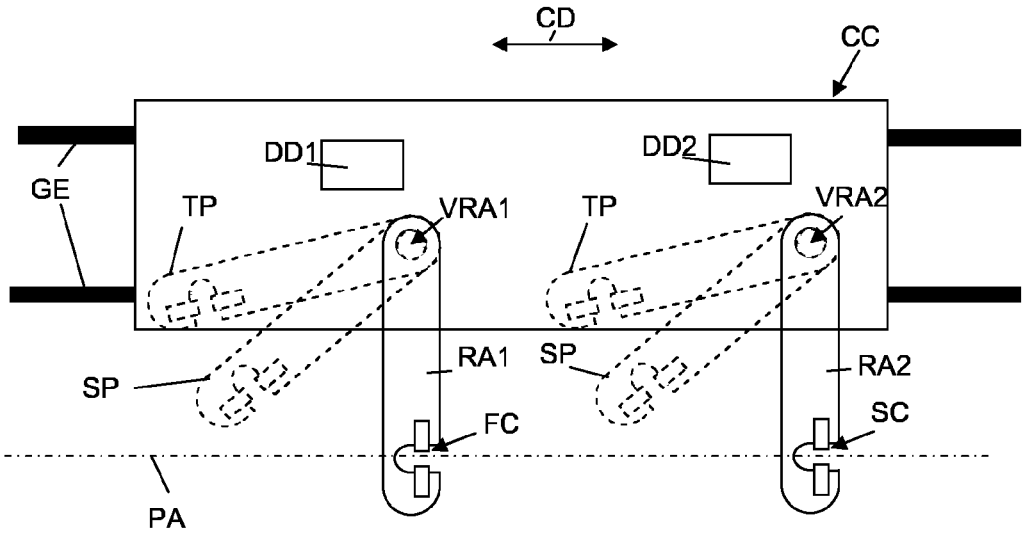
FIG. 9 depicts schematically a suspension assembly according to a further embodiment of the invention.

FIG. 9 depicts a suspension assembly according to another embodiment of the invention. The suspension assembly comprises a suspension carriage CC moveable in a horizontal carriage direction CD along guide elements GE. The suspension carriage CC comprises a first suspension device FC and a second suspension device SC, each configured to hold a string of drilling tubulars suspended in the sea.

The first and second suspension devices FC and SC are provided on respective arms RA1 and RA2 which arms are rotatable about respective vertical rotation axes VRA1 and VRA2. As a result thereof, the first and second suspension devices FC and SC are each moveable between a first position (shown in solid lines), in which the first and second device are located at a path PA which intersects a first and second firing line of a drilling vessel, so that the first and second suspension device are able to approach and engage with a string of drilling tubulars in the first or second firing line, and a second position (shown in dashed lines and indicated by reference symbol SP), in which the first and second suspension devices are retracted from the path PA, so that the first and second suspension device are not able to approach and engage with a string of drilling tubulars in the first or second firing line. In the second position, the first and second suspension devices are thus able to pass a string of drilling tubulars present in path PA, which makes this suspension assembly a versatile and flexible system for handling strings of drilling tubulars.

Further, the first and second suspension devices are operable by separate driving devices DD1 and DD2, so that the first and second suspension devices can be operated independently from each other.

Not shown, but in a practical embodiment, it will be apparent for the skilled person to take measures in order to ensure that the moment caused by the weight of the string of drilling tubulars suspended by the first and/or second suspension devices is compensated, for instance by providing sufficient counterweight on the suspension carriage or by constraining an upward movement of the suspension carriage at an upper surface of the suspension carriage. Other measures are also envisaged.

As shown in FIG. 9, the first and second suspension devices may also be moveable to a third position (shown in dashed lines and indicated with reference symbol TP) in which the arms are fully retracted into the suspension carriage. The third position may be advantageous to allow the passage of a local bulge in the string of drilling tubulars in a similar manner as described for the third position of the arm of the suspension assembly of FIG. 1.

The arms RA1 and RA2 including rotation possibility may be replaced by other actuation mechanisms known to the person skilled in the art, such as a translational mechanism in which the first and second suspension devices are moved in a translation direction perpendicular to the carriage direction only, e.g. using hydraulic cylinders.

Figure 10:
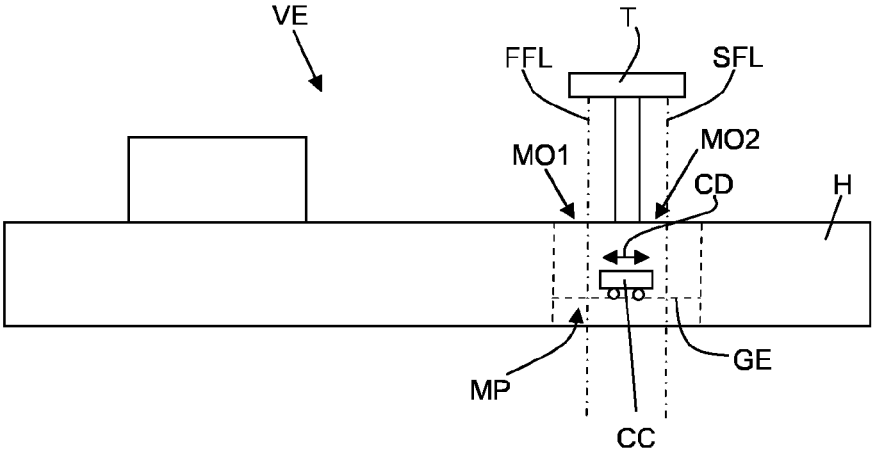
FIG. 10 depicts schematically a drilling vessel according to an embodiment of the invention.

FIG. 10 depicts a drilling vessel VE for drilling in the earth's surface from said vessel, for example for oil or gas, said drilling vessel comprising a hull H with a moonpool MP extending substantially through the hull H.

A mast T is provided in the middle of the moonpool, said mast defining a first firing line FFL extending substantially vertically through a first moonpool opening MO1, and a second firing line SFL extending substantially vertically through a second moonpool opening MO2. The first moonpool opening MO1 and the second moonpool opening MO2 are in communication with each other below the mast T to form a single moonpool.

Below the mast T, guide elements GE are provided along which a suspension carriage of a suspension assembly according to the invention is moveable between the first and second firing line. The guide elements GE define a carriage direction CD, said carriage direction being the direction in which the suspension carriage is moveable. The suspension assembly is not depicted in more detail, but for more details about possible embodiments, reference is made to the description and to FIGS. 1-9, and to the appended claims.

The invention claimed is:

1. A drilling vessel for drilling in the earth's surface from said vessel, comprising:

a hull with a moonpool extending through the hull;

a first firing line extending substantially vertically through the moonpool;

a second firing line extending substantially vertically through the moonpool remote from the first firing line;

a suspension carriage, the suspension carriage being moveable in a substantially horizontal carriage direction, a first suspension device provided on the suspension carriage to hold a string of drilling tubulars suspended in the sea; and a second suspension device provided on the suspension carriage to hold a string of drilling tubulars suspended in the sea, wherein the first suspension device is fixed to the suspension carriage to provide a stationary suspension position relative to the suspension carriage, wherein the second suspension device is moveable relative to the suspension carriage in at least a horizontal direction perpendicular to the carriage direction between a first position relative to the suspension carriage and a second position relative to the suspension carriage, wherein both the first suspension device and the second suspension device, when in the first position, are moveable along a path by movement of the suspension carriage in the carriage direction, wherein the path starts at a retracted position, in which the suspension carriage, first suspension device and second suspension device do not interfere with drilling and building operations in the first and second firing line, and subsequently intersects the first firing line and the second firing line respectively, wherein in the first position of the second suspension device relative to the suspension carriage, the second suspension device is able to approach and engage with a string of drilling tubulars in the first or second firing line starting from the retracted position, and wherein in the second position of the second suspension device relative to the suspension carriage, the first suspension device is able to approach and engage with a string of drilling tubulars in the first or second firing line starting from the retracted position.

2. The drilling vessel according to claim 1, further comprising a drilling system adapted to carry out drilling along one of the first and second firing line, and a building system adapted to build or dismantle a string of drilling tubulars along the other one of the first and second firing line.

3. The drilling vessel according to claim 2, wherein the drilling system is also configured to build or dismantle a string of drilling tubulars along said one of the first and second firing line.

4. The drilling vessel according to claim 3, wherein the building system is also configured to carry out drilling along said other one of the first and second firing line.

5. The drilling vessel according to claim 3, wherein the second suspension device is provided on an arm that is rotatably mounted to the suspension carriage about a vertically extending rotation axis, such that the second suspension device is moveable in a horizontal plane.

6. The drilling vessel according to claim 2, wherein the building system is also configured to carry out drilling along said other one of the first and second firing line.

7. The drilling vessel according to claim 6, wherein the second suspension device is provided on an arm that is rotatably mounted to the suspension carriage about a vertically extending rotation axis, such that the second suspension device is moveable in a horizontal plane.

8. The drilling vessel according to claim 2, wherein the drilling system is adapted to carry out drilling along the second firing line, and wherein the building system adapted to build or dismantle a string of drilling tubulars along the first firing line.

9. The drilling vessel according to claim 8, wherein the second suspension device is provided on an arm that is rotatably mounted to the suspension carriage about a vertically extending rotation axis, such that the second suspension device is moveable in a horizontal plane.

10. The drilling vessel according to claim 2, wherein the second suspension device is provided on an arm that is rotatably mounted to the suspension carriage about a vertically extending rotation axis, such that the second suspension device is moveable in a horizontal plane.

11. The drilling vessel according to claim 2, wherein the suspension carriage comprises a U-shaped frame, wherein the first suspension device is provided on a frame member connecting the two legs of the U-shaped frame, and wherein the second suspension device is moveably mounted to one of the legs of the U-shaped frame.

12. The drilling vessel according to claim 1, wherein the second suspension device is provided on an arm that is rotatably mounted to the suspension carriage about a vertically extending rotation axis, such that the second suspension device is moveable in a horizontal plane.

13. The drilling vessel according to claim 1, wherein the suspension carriage comprises a U-shaped frame having two legs, wherein the first suspension device is provided on a frame member connecting the two legs of the U-shaped frame, and wherein the second suspension device is moveably mounted to one of the legs of the U-shaped frame.

14. The drilling vessel according to claim 13, wherein a free space in between the two legs of the U-shaped frame is large enough to allow the passage of a local bulge in the string of drilling tubulars.

15. The drilling vessel according to claim 14, wherein the second suspension device is moveable to a third position relative to the suspension carriage to allow the passage of said local bulge in the string of drilling tubulars.

16. A method in which use is made of the drilling vessel according claim 1, said method comprising the following steps starting from the suspension carriage being positioned in the retracted position:

a. providing a first string of drilling tubulars in the first firing line;

b. providing a second string of drilling tubulars in the second firing line;

c. providing the second suspension device in the second position;

d. holding the first string of drilling tubulars using the first suspension device on the suspension carriage;

e. moving the suspension carriage towards the second firing line;

f. moving the second suspension device to the first position;

g. holding the second string of drilling tubulars using the second suspension device;

h. moving the suspension carriage, such that the first string of drilling tubulars held by the first suspension device is positioned in the second firing line;

i. releasing the first string of drilling tubulars in the second firing line by the first suspension device;

j. moving the second suspension device to the second position;

k. moving the suspension carriage towards the first firing line until the second suspension device, which holds the second string of drilling tubulars, has passed the second firing line in which the first string of drilling tubulars is located without interfering with the first string of drilling tubulars; and l. moving the suspension carriage towards the first firing line and the second suspension device back to the first position until the second string of drilling tubulars held by the second suspension device is positioned in the first firing line.

17. The method according to claim 16, wherein the first string of drilling tubulars is a drill string.

18. The method according to claim 16, wherein the second string of drilling tubulars is a drill string.

19. The method according to claim 16, wherein the second string of drilling tubulars is a casing string.

20. A drilling vessel for drilling in the earth's surface from said vessel, comprising:

a hull with a moonpool extending through the hull;

a first firing line extending substantially vertically through the moonpool;

a second firing line extending substantially vertically through the moonpool remote from the first firing line;

a suspension carriage, the suspension carriage being at least moveable in a substantially horizontal carriage direction between the first and second firing line;

a first suspension device provided on the suspension carriage to hold a string of drilling tubulars suspended in the sea; and a second suspension device provided on the suspension carriage to hold a string of drilling tubulars suspended in the sea, wherein each of the first and second suspension devices is moveable relative to the suspension carriage in at least a direction perpendicular to the horizontal traveling direction of the suspension carriage between a first position, in which the first and second suspension devices are able to approach and engage with a string of drilling tubulars in the first or second firing line, and a second position, in which the first and second suspension devices are not able to approach and engage with a string of drilling tubulars in the first or second firing line, and wherein each of the first and second suspension devices has an associated driving device, so that the first and second suspension device can be moved between the first and second position by the respective driving device independent of each other.

* * * * *